US005270613A

United States Patent [19]

Kim

[11] Patent Number: 5,270,613

[45] Date of Patent: Dec. 14, 1993

[54] TWO SIDED FLUORESCENT INDICATOR PANEL

[75] Inventor: Yu S. Kim, Seoul, Rep. of Korea

[73] Assignee: SamSung Electronics Co., Ltd., Suwon, Rep. of Korea

[21] Appl. No.: 437,460

[22] Filed: Nov. 16, 1989

[30] Foreign Application Priority Data

Nov. 17, 1988 [KR] Rep. of Korea ..... 88-18724

[51] Int. Cl.[5] ..... H01J 1/62

[52] U.S. Cl. ..... 313/496; 313/293; 313/303; 313/493; 345/55

[58] Field of Search ..... 313/293, 493, 302, 303, 313/496, 497; 340/716, 717

[56] References Cited

U.S. PATENT DOCUMENTS

| | | | |
|---|---|---|---|
| 3,657,587 | 4/1972 | Kegelman | 313/496 |
| 3,727,213 | 4/1973 | Kurtenbach | 340/717 X |
| 4,406,998 | 9/1983 | Willough | 340/717 X |
| 4,455,774 | 6/1984 | Watanabe | 313/496 X |
| 4,472,658 | 9/1984 | Morimoto et al. | 313/497 |
| 4,551,737 | 11/1985 | Inokuchi | 313/496 X |
| 4,588,921 | 5/1986 | Tischer | 313/496 |
| 4,841,194 | 6/1989 | Kishino et al. | 313/496 |

FOREIGN PATENT DOCUMENTS

| | | | |
|---|---|---|---|
| 0060066 | 5/1977 | Japan | 313/496 |

*Primary Examiner*—Donald J. Yusko
*Assistant Examiner*—Brian Zimmerman
*Attorney, Agent, or Firm*—Robert E. Bushnell

[57] ABSTRACT

A two-sided fluorescent indicator panel is disclosed which uses two multilayer base plate assemblies, each of them being constituted such that a grid is attached on the multilayer base plate formed by stacking the required functional layers on a base plate, and being mutually opposingly disposed with their grid-attached sides facing each other; and one or a plurality of filaments disposed between the two base plate assemblies. According to the present invention, the structure of the device becomes simple, and the manufacturing process becomes also simple, thereby making it possible to produce a light, miniature, power-saving digital indicator panel.

21 Claims, 2 Drawing Sheets

TWO SIDED FLUORESCENT INDICATOR PANEL

FIELD OF THE INVENTION

The present invention relates to a fluorescent indicator panel (FIP), and particularly to a new both-side fluorescent indicator panel which is capable of displaying characters on the both sides thereof.

BACKGROUND OF THE INVENTION

FIG. 1 illustrates the constitution of the usual fluorescent indicator panel which is used as a digital indicator for displaying characters or symbols in the digital form in electronic meters, electronic calculators or communication apparatuses. This kind of fluorescent indicator panel is disclosed in Japanese Patent Publication No. Sho-54-41459.

The upper face of a base plate 9 which is made of an insulative material such as glass or ceramic is provided with functional layers such as: a wiring layer 10 forming a wiring pattern and made of a conductive material such as silver and the like; an insulative layer 11 made of a glass coating material including a black pigment and the like; a conductive layer 12 having a required pattern and forming an anode segment including a conductive ingredient such as graphite; and a fluorescent layer 13 made of a fluorescent material, the above layers being stacked in the cited order through printing technology and the like. Such a base plate 9 provided with the functional layers will be called "multilayer base plate" hereinafter.

A grid 14 for controlling emitted electrons in order to make the fluorescent layer 13 radiate is installed on the multilayer base plate, and a filament 16 for emitting the thermal electrons is installed by a filament supporter 17 fixed on the front and rear (or on the left and right) of the multilayer base plate. An envelope 15 playing the role of a front glass is attached in such a manner that the upper portion of the multilayer base plate should be surrounded, and thus, the conventional fluorescent indicator is completed by performing bonding, discharging and getter flashing and other required procedures.

However, such a conventional fluorescent indicator panel is capable of displaying the characters only on one side thereof, and if two sides are to be displayed, two panels have to be combined. Further, only a part of the heat produced from the filament can be utilized, and the rest of the heat is released to the envelope, thereby making the utilization of the heat insufficient. Further, in order to prevent the electrostatic charges in the envelope which has no special grounding means, an anti-electrostatic coating has to be carried out, thereby increasing the manufacturing cost.

SUMMARY OF THE INVENTION

The present invention is intended to overcome the disadvantages of the conventional techniques.

Therefore, it is the object of the present invention to provide a both-side (i.e., a two-sided) fluorescent indicator panel which is not only capable of providing a display on both sides thereof, but also is simple in its structure, and low in manufacturing cost.

In achieving the above objects, the both-side fluorescent indicator panel according to the present invention uses:

two multilayer base plate assemblies, each of them which is constituted such that a grid is attached on the upper portion of a multilayer base plate provided with required functional layers, on a base plate, composed of a conductive layer of a predetermined pattern, a wiring layer electrically connected to the conductive layer, and a fluorescent layer formed on the upper portion of the conductive layer, each of the multilayer base plate assemblies being opposed to each other with each grid-attached side as an internal side; and a thermal electron emitting source provided with one of a plurality of filaments, actually disposed on the same plain, between said two base plate assemblies, whereby both multilayer base plates commonly have the one thermal electron emitting source disposed at the center there between.

BRIEF DESCRIPTION OF THE DRAWINGS

The above objects and other advantages of the present invention will become more apparent by describing in detail the preferred embodiment of the present invention with reference to the attached drawings in which.

DESCRIPTION OF THE PREFERRED EMBODIMENT

Figure 2:
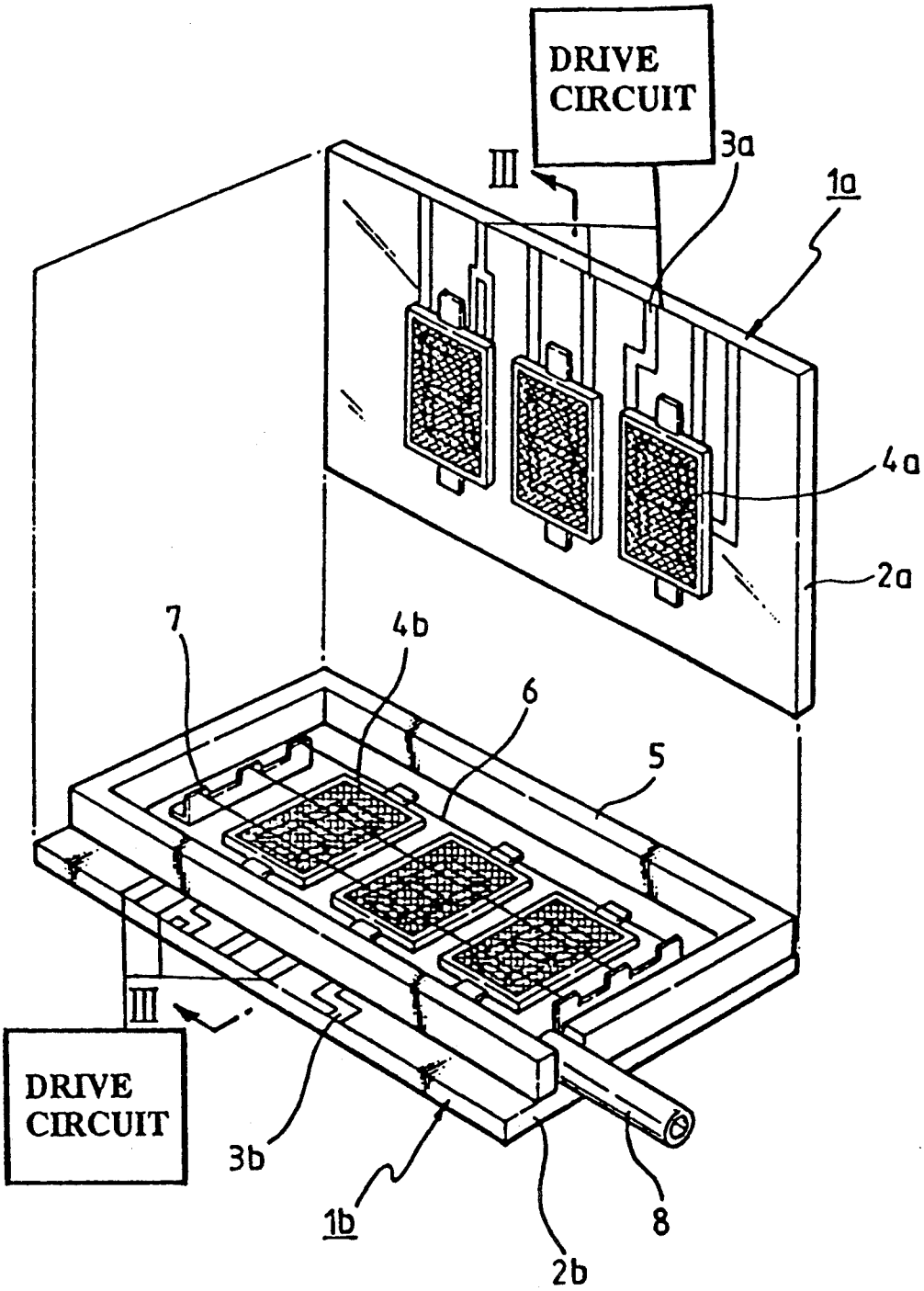
FIG. 2 is an exploded perspective view of the both-side fluorescent indicator panel according to the present invention.

The two-sided fluorescent indicator panel according to the present invention as shown in FIG. 2 may be made with: two multilayer base plate assemblies, each of them being constituted such that a grid 4*a*(4*b*) is attached on a multilayer base plate 1*a*(1*b*) formed by stacking the required functional layers 3*a*(3*b*) on the base plate 2*a*(2*b*) respectively; a side wall 5 which maintains a certain gap between said two multilayer base plate assemblies, and forms a sealed space together with them; and one or a plurality of filaments 6 which are supported by filament supports 7 installed on either one of the two multilayer base plate assemblies, and are disposed separately by a certain distance from the grids 4*a*(4*b*). Reference numeral 8 indicates a discharge conduit which is open to the sealed space which is formed by the two multilayer base plates 1*a*,1*b* and the side walls 5. In the drawing, the affixed codes a and b respectively indicate the components related to one of the multilayer base plate assemblies, and the components related to the other one of the multilayer base plate assemblies.

Figure 1:
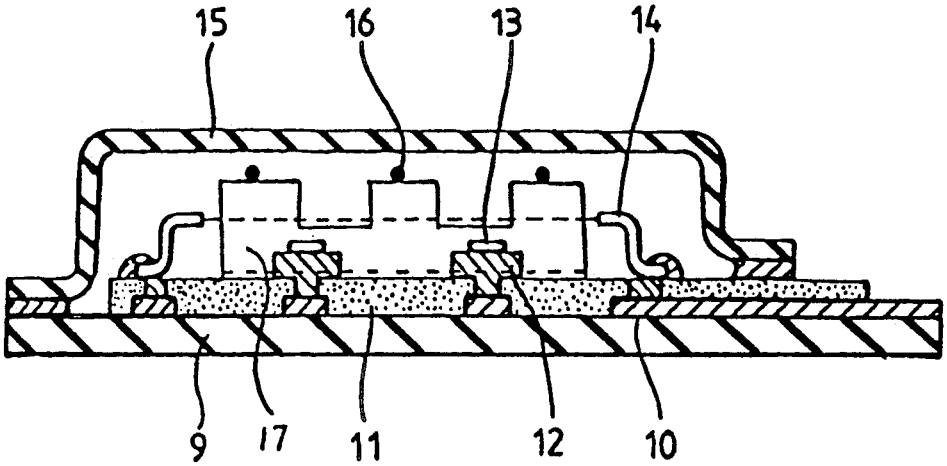
FIG. 1 PRIOR ART
FIG. 1 is a sectional view of the conventional fluorescent indicator panel.
Figure 3:
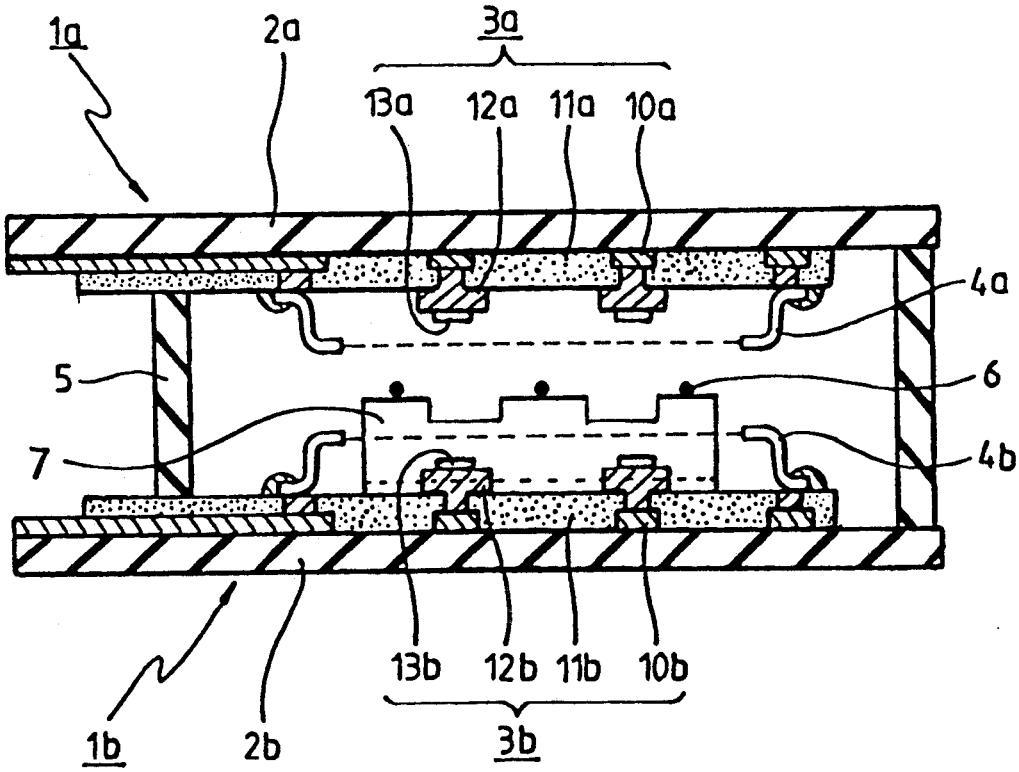
FIG. 3 is a sectional view taken along the line III—III of FIG. 2.

FIG. 3 is a detailed sectional view taken along the line III—III of FIG. 2, and the drawing exaggerates in the direction of the height for the sake of the illustrating convenience.

The multilayer base plates 1*a*,1*b* are formed by stacking the required functional layers 3*a*,3*b* on the base plates 2*a*,2*b* and a desirable method of forming them will be described below.

The base plates 2*a*,2*b* are made of a transparent material such as glass, and on the upper faces thereof, the functional layers 3*a*,3*b* are stacked, which desirably has wiring layers 10*a*,10*b* forming a wiring pattern; insulative layers 11*a*,11*b* made of an insulative material; conductive layers 12*a*,12*b* of the required pattern forming anode segments; and fluorescent layers 13*a*,13*b* deposited upon the conductive layers in a manner similar to the conventional one.

The light rays which are generated from the fluorescent layers 13a,13b pass through the wiring layers 10a,10b, the insulative layers 11a,11b, the conductive layers 12a,12b, and the base plates 2a,2b to be ultimately visually recognized by the observer. Therefore, the above three kinds of the layers should be desirably made of a transparent conductive paste, or a glass coating material, while a conventional printing method may be desirably used for the stacking of the layers. Meanwhile a proper consideration, for example, the provision of a separate black layer, should be taken in order to prevent the lowering of the luminance.

The couplings between the multilayer base plates 1a,1b, the side walls 5 and the discharge conduit 8 may be conducted in such a manner that a crystalline powdered glass, so-called "frit", is spread, and then, a baking is carried out, while the metal components such as the grids 4a,4b and the filament support 7 are attached on the multilayer base plates 1a,1b through the use of frit or a conductive adhesive. And, the plurality of filaments 6 supported by the filament supporter 7 form a thermal electron emitting plate, and are substantially formed at equal intervals on the same plane.

Then, the both-side fluorescent indicator panel constituted as above according to the present invention is subjected to proper finishing processes such as bonding, discharging, getter flashing and aging before the final completion of the products.

The two-sided fluorescent indicator panel of the present invention constituted as above will now be described as to its operations.

Upon supplying of the power from a power source(-not shown), the filaments 6 start the radiation of heat to emit thermal electrons. At this time, if a proper driving voltage is supplied from a driving circuit (not shown) through the wiring layers 10a,10b of the multilayer base plates 1a,1b to the proper segment of the conductive layers 12a,12b, and the grids 4a, 4b, the fluorescent layers 13a, 13b of the conductive layers 12a, 12b selected by the driving voltage start light emissions by the emitted electrons accelerated by the grids 4a, 4b, and the emitted light transmits the above described functional layers and the transparent base plates to reach the observers. Thus, the observer recognizes the displayed characters, and the displaying of characters through both sides of one fluorescent indicator panel is made possible.

In the case where separate driving signals are supplied respectively to the two multilayer base plates 1a,1b, the two sides of the fluorescent indicator panel can provide different kinds of information respectively.

As described in that the both-side base plates 2a, 2b commonly have the thermal electron emitting source being in one plane and disposed at the center between both-side base plates. That is to say, the grids 4a,4b of the two multilayer base plate assemblies control the thermal electrons from a single filament 6, as a thermal electron emitting source, disposed in one plane to activate the fluorescent layers 13a,13b, with the result that the structure becomes simpler, and that the heat from the filament 6 can be more efficiently utilized. Further, owing to the fact that the base plates 2a,2b serve as an envelope or a front glass, no separate envelope is required, and an anti-electrostatic coating for the envelope is not required, thereby enabling to simplification of the manufacturing process.

Thus, the both-side fluorescent indicator panel according to the present invention is compact, power-saving, and superior in its performances compared with the conventional digital indicators.

What is claimed is:

1. A two-sided fluorescent indicator panel comprising:

two multilayer base plate assemblies each comprising functional layers, with each of said functional layers being composed of a conductive layer of a predetermined pattern, a wiring layer electrically connected to said conductive layer, a fluorescent layer formed on an upper portion of said conductive layer, and a grid disposed by supporters on an upper portion of said functional layers;

wherein each of said multilayer base plate assemblies being opposed to each other with each grid as an internal side; and one or a plurality of filaments, as a common thermal electron emitting source, substantially disposed in a plane, whereby both of said multilayer base plates are supplied with thermal electrons from said common thermal electron emitting source.

2. The two-sided fluorescent indicator panel as claimed in claim 1, wherein both of said multilayer base plate assemblies are separated from each other at a predetermined interval by interposing a side wall and said common thermal electron emitting source is provided between both of said multilayer base plates.

3. The two sided fluorescent indicator panels claimed in claim 1, wherein said one or a plurality of said filaments are supported by means of filament supporters attached on either one of said multilayer base plate assemblies.

4. The two sided fluorescent indicator panel as claimed in claim 1, wherein said functional layers of said respective multilayer base plate assemblies are commonly driven by means of one driving circuit.

5. The two sided fluorescent indicator panel of claim 1, further comprised of said common thermal electron emitting source being positioned between said two multilayer base plate assemblies.

6. An indicator panel, comprising:

a plurality of individual, spaced-apart base plate assemblies; and electrically conducting filament means disposed for serving as a source of energy common to all of said plurality of spaced-apart plate assemblies;

each of said assemblies comprising:

a layer of electrically conductive material, a plurality of discrete light emitting elements positioned in a planar array to receive electrical energy from said conductive layer, and a grid disposed adjacent to and spaced between said light emitting elements and said filament means.

7. The indicator panel of claim 6, wherein said light emitting elements each comprise corresponding layers of fluorescent material.

8. The indicator panel of claim 6, further comprised of:

a wiring layer electrically coupling said plurality of light emitting elements to said conductive means, interposed between said conductive layer and said plurality of light emitting elements in each of said base plate assemblies.

9. The indicator panel of claim 6, further comprised of each of said base plate assemblies having a transparent base, with each said transparent base being oriented a different direction.

10. The indicator panel of claim 6, further comprised of each of said base plate assemblies having a transparent base, with each said transparent base being oriented a different direction, whereby a perpendicular passing through a centroid of one of said base plates describes an angle of 180° with a perpendicular passing through a centroid of another one of said base plates.

11. The indicator panel of claim 6, further comprised of said filament means forming a continuous structure extending between substantially all of said light emitting elements.

12. The indicator panel of claim 6, further comprised of:

each of said base plate assemblies being distinct; and means interposed between pairs of said base plate assemblies, for maintaining said pairs of base plate assemblies spaces apart.

13. The indicator panel of claim 11, further comprised of:

each of said base plate assemblies being distinct; and means interposed between pairs of said base plate assemblies, for maintaining said pairs of base plate assemblies spaces apart.

14. The indicator panel of claim 10, further comprised of said filament means forming a continuous structure extending between substantially all of said light emitting elements.

15. The indicator panel of claim 14, further comprised of:

each of said base plate assemblies being distinct; and means interposed between pairs of said base plate assemblies, for maintaining said pairs of base plate assemblies spaced apart.

16. An indicator panel, comprising:

a casing containing an evacuated chamber;

a plurality of oppositely positioned substrates disposed in said evacuated chamber, each said substrate being formed of optically transparent and electrically insulating material;

at least one display section formed on each of said plurality of substrates;

each of said display sections having a plurality of segments each comprising electrical conductors having a phosphor layer deposited on the surface of each of the electrical conductors, and a grid disposed above said phosphor layer;

a filament stretched between and separated from said phosphor layer of each of said display sections by said grids of said oppositely positioned substrates;

wherein said casing comprises a front member for permitting a first external view of a first one of said substrates and a rear member for permitting a second external view of a second one of said substrates disposed opposite from said first one of said substrates;

and wherein said plurality of oppositely positioned substrates are disposed in said evacuated chamber with said filament positioned between said display sections of said plurality of oppositely disposed substrates, whereby said filament is positioned as a source of energy common to all of said display sections of said plurality of oppositely disposed substrates.

17. An indicator panel, comprising:

a casing containing an evacuated chamber;

a plurality of oppositely positioned substrates disposed in said evacuated chamber, each said substrate being formed of optically transparent and electrically insulating material;

at least one display section formed on each of said plurality of substrates;

each of said display sections having a plurality of segments each comprising electrical conductors having a phosphor layer deposited on the surface of each of the electrical conductors;

a filament for emitting electrons positioned between and separated from said display sections of opposite ones of said oppositely positioned substrates;

wherein said casing comprises a front member for permitting a first external view of a first one of said substrates and a rear member for permitting a second external view of a second one of said substrates disposed opposite from said first one of said substrates;

and wherein said plurality of oppositely positioned substrates are disposed in said evacuated chamber with said filament positioned between said display sections of said plurality of oppositely disposed substrates, whereby said filament is positioned as a source of energy common to all of said display sections of said plurality of oppositely disposed substrates.

18. An indicator panel, comprising:

a pair of spaced-apart transparent insulating substrates defining a pair of opposed surfaces;

wiring means formed on each of said opposed surfaces of said transparent substrates, for conducting display signals;

transparent conductive films applied in segments upon said wiring means;

layers of light emitting material disposed upon sections of said wiring means to form spaced-apart opposite arrays of said light emitting material on each of said substrates;

means mounted between, and spaced apart from, said layers of light emitting material, and disposed for emitting electrons to commonly impinge said electrons upon said layers of light emitting material supported by both of said substrates; and means for maintaining an evacuated casing around and supporting said pair of substrates in a spaced-apart relation with said arrays of layers of light emitting material supported by each of said substrates facing opposite sides of said electron emitting means.

19. The indicator panel of claim 18, wherein said electron emitting means comprises:

a filament extending between said arrays of layers of light emitting material supported by both of said substrates; and a plurality of grids disposed between said filament and corresponding ones of said arrays of light emitting material.

20. The indicator panel of claim 19, wherein said light emitting material comprises a fluorescent substance.

21. The two sided fluorescent indicator panel as claimed in claim 1, wherein said functional layers of said respective multilayer base plate assemblies are separately driven by means of respective driving circuits.

* * * * *